US007083361B2

(12) United States Patent
De Felice

(10) Patent No.: US 7,083,361 B2
(45) Date of Patent: Aug. 1, 2006

(54) AQUATIC BREATHING APPARATUS, SYSTEM, AND ASSOCIATED METHODS

(75) Inventor: Christopher J. De Felice, Oakland, FL (US)

(73) Assignees: Aquaturis, Inc., Oakland, FL (US); Zeagle Systems, Inc., Zephyrhills, FL (US)

( * ) Notice: Subject to any disclaimer, the term of this patent is extended or adjusted under 35 U.S.C. 154(b) by 0 days.

(21) Appl. No.: 11/062,365

(22) Filed: Feb. 22, 2005

(65) Prior Publication Data

US 2005/0191135 A1 Sep. 1, 2005

Related U.S. Application Data

(60) Provisional application No. 60/547,841, filed on Feb. 26, 2004.

(51) Int. Cl.
*B63C 11/02* (2006.01)

(52) U.S. Cl. ..... 405/186; 405/185; 405/187

(58) Field of Classification Search ..... 405/185–187; 441/108, 118; 128/202.14
See application file for complete search history.

(56) References Cited

U.S. PATENT DOCUMENTS

| | | | | | |
|---|---|---|---|---|---|
| 143,097 | A * | 9/1873 | Schneider | 411/130 |
| 2,238,759 | A * | 4/1941 | Vestrem | 128/201.25 |
| 2,844,145 | A * | 7/1958 | Berge | 128/205.22 |
| 2,975,439 | A | 5/1961 | Bentley | |
| 3,536,071 | A * | 10/1970 | Ferrando | 128/202.14 |
| 3,747,139 | A * | 7/1973 | Braly | 405/186 |
| 5,092,327 | A * | 3/1992 | Tragatschnig | 128/205.13 |
| 5,295,765 | A * | 3/1994 | Choi | 405/186 |
| 5,516,233 | A * | 5/1996 | Courtney | 405/186 |
| 5,606,967 | A | 3/1997 | Wang | |
| 5,855,454 | A * | 1/1999 | Courtney et al. | 405/186 |
| 5,954,250 | A * | 9/1999 | Hall et al. | 224/262 |
| 6,354,295 | B1 | 3/2002 | Hasson, Jr. | |
| 6,478,510 | B1 * | 11/2002 | Young | 405/186 |
| 2004/0052585 | A1 * | 3/2004 | Ellwitz | 405/186 |

FOREIGN PATENT DOCUMENTS

| | | | |
|---|---|---|---|
| EP | 360636 | * | 3/1990 |
| WO | 9313978 | * | 7/1993 |

OTHER PUBLICATIONS

AquaLung, U.S. Divers products brochure, acknowledged prior art, undated.

* cited by examiner

*Primary Examiner*—Jong-Suk (James) Lee
(74) *Attorney, Agent, or Firm*—Allen, Dyer, Doppelt, Milbrath & Gilchrist, P.A.

(57) ABSTRACT

An aquatic breathing apparatus includes a buoyancy vest for aquatic breathing. The vest includes a weight-bearing back portion positionable adjacent a back of a user and a front portion positionable adjacent the chest. The front portion includes a support element adapted for removably affixing an air tank thereto. The support element is positioned for resting adjacent a sternum. A buoyancy element is housed within the front portion, and a pair of side straps is provided wherein each side strap is affixable to connect the front and the back portion to respective opposed sides thereof. A system for aquatic breathing includes the buoyancy vest and an air tank and a regulator. The regulator comprises a hose that is connected in fluid communication at a first end to the air tank and at a second end to a mouthpiece. The hose is supported by a second support element on the vest.

19 Claims, 5 Drawing Sheets

AQUATIC BREATHING APPARATUS, SYSTEM, AND ASSOCIATED METHODS

CROSS-REFERENCE TO RELATED APPLICATION

This application claims priority to provisional application Ser. No. 60/547,841, filed on Feb. 26, 2004, entitled "Underwater Breathing Apparatus and Method."

FIELD OF INVENTION

The present invention generally relates to aquatic breathing apparatus, and, in particular, to systems and methods for enabling underwater breathing.

BACKGROUND

Conventional scuba diving equipment typically includes a mouthpiece connected to a hose, which in turn is connected to a high-pressure air tank. Such conventional scuba diving equipment may also include goggles and a buoyancy compensator. Modified snorkeling equipment typically includes a long, flexible air hose having one opening that is secured to a float on the surface of the water and another opening that is placed in a user's mouth. Such snorkeling equipment allows the user to snorkel at greater distances from the surface of the water than conventional snorkeling equipment.

One disadvantage of currently available scuba equipment is that a user is not necessarily balanced on the surface of the water because the tank is heavy and out of the water. In fact, some equipment can even fall to one side, making the diver roll over inadvertently. This can be dangerous for an inexperienced swimmer. Another disadvantage with conventional scuba diving equipment is that it is heavy and cumbersome, especially out of the water, and while entering the water. A further disadvantage is that learning to use conventional scuba equipment takes a long time and requires proof of certification in order to obtain tanks of air.

It would be beneficial, therefore, to provide an apparatus and system for overcoming these disadvantages.

SUMMARY OF THE INVENTION

The present invention is directed to an aquatic breathing apparatus, system, and associated methods. A first aspect of the invention is directed to a buoyancy vest for aquatic breathing. The buoyancy vest comprises a back portion positionable adjacent a back of a user and a front portion positionable adjacent a chest of the user. The front portion comprises a support element that is adapted for removably affixing an air tank thereto. The support element is positioned for resting adjacent a sternum of the user.

A buoyancy element, which may provide variable buoyancy or have a constant buoyancy, is housed within the front portion, and a pair of side straps is provided wherein each side strap is affixable in connecting relation between the front and the back portion to respective opposed sides thereof.

Another aspect of the invention is directed to a system for aquatic breathing. The system comprises the buoyancy vest as described above. The system further comprises an air tank supported by the support element and a regulator. The regulator comprises a hose that is connected in fluid communication at a first end to the air tank and at a second end to a mouthpiece. The hose is supported by a second support element affixed to the vest.

One aspect of a method of the present invention is directed to a method for achieving controlled breathing of a desired gas. The method comprises the steps of placing a front portion of a vest adjacent a sternum of a user and placing a back portion of the vest adjacent a back of the user. The front and the back portion of the vest are affixed together using releasable, length-adjustable side straps.

An air tank is attached to the vest, preferably in a substantially horizontal orientation, using releasable length-adjustable straps that are affixed to the vest front portion. A regulator is attached to the air tank for permitting a flow of air from the air tank to a mouthpiece of the regulator. A buoyancy of a buoyancy compensator, if used, is adjusted to a desired level, and the user can breathe through the mouthpiece.

Another aspect of the invention is directed to a method for providing an aquatic breathing experience to a customer. This aspect of the method comprises the steps of establishing an aquatic breathing system outlet adjacent a body of water and offering to rent an aquatic breathing system to a customer.

The customer is permitted to don the aquatic breathing system by placing a front portion of a vest adjacent a sternum of the customer and placing a back portion of the vest adjacent a back of the customer. The front and the back portion of the vest are affixed together using releasable, length-adjustable side straps that are affixed in connecting relation therebetween.

Next an air tank is attached to the vest in a substantially horizontal orientation using releasable length-adjustable straps affixed to the vest front portion. A regulator is attached to the air tank for permitting a flow of air from the air tank to a mouthpiece of the regulator.

The customer is permitted to enter the body of water and to adjust a buoyancy of a buoyancy compensator, if present, to a desired level and then to breathe through the mouthpiece. When the experience is finished, the aquatic breathing system is received back from the customer.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention will now be presented with reference to FIGS. 1–5.

Figure 1:
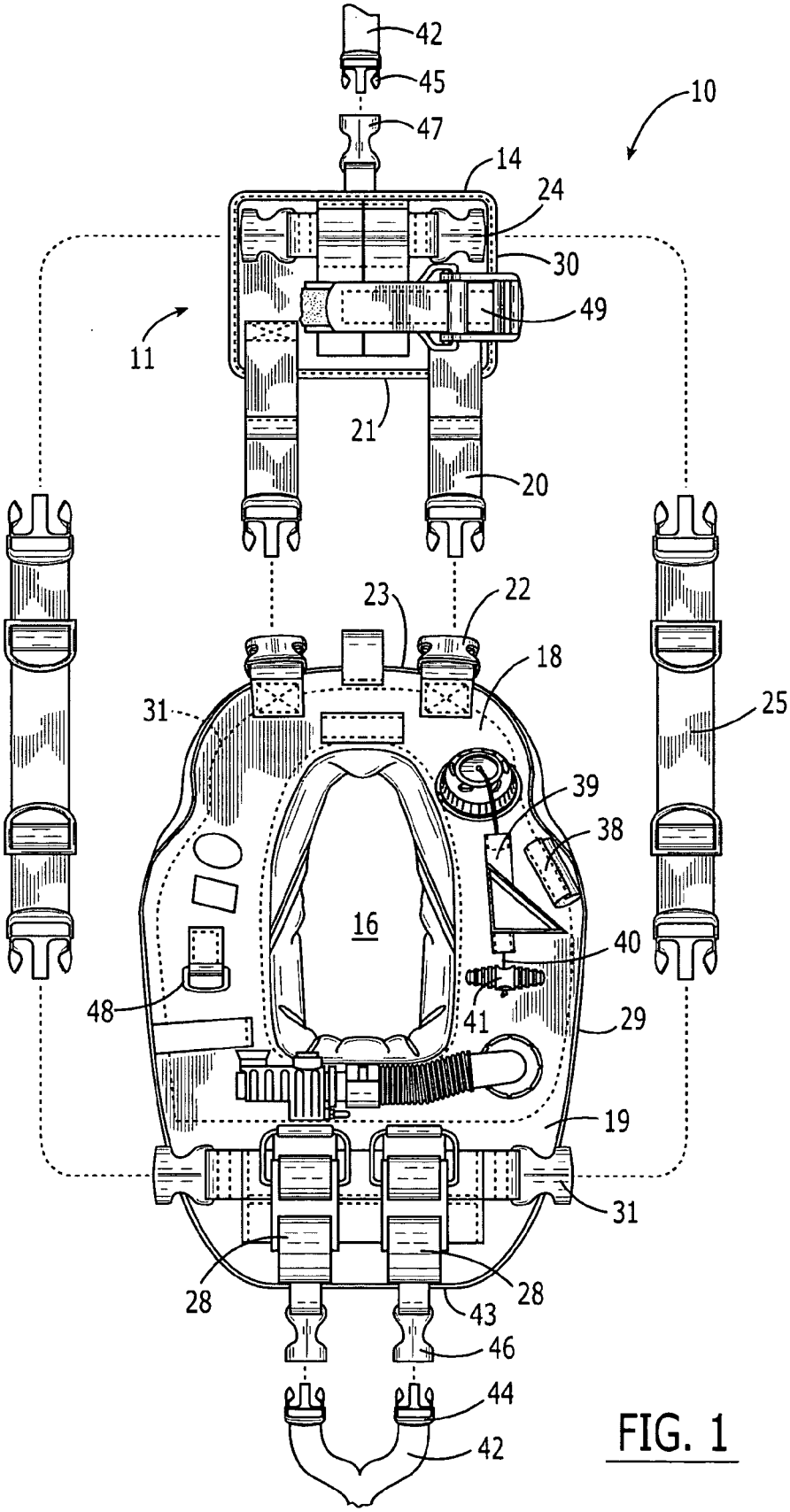
FIG. 1 is an exploded top plan view of a first embodiment of a buoyancy vest of the present invention positioned flat.
Figure 2:
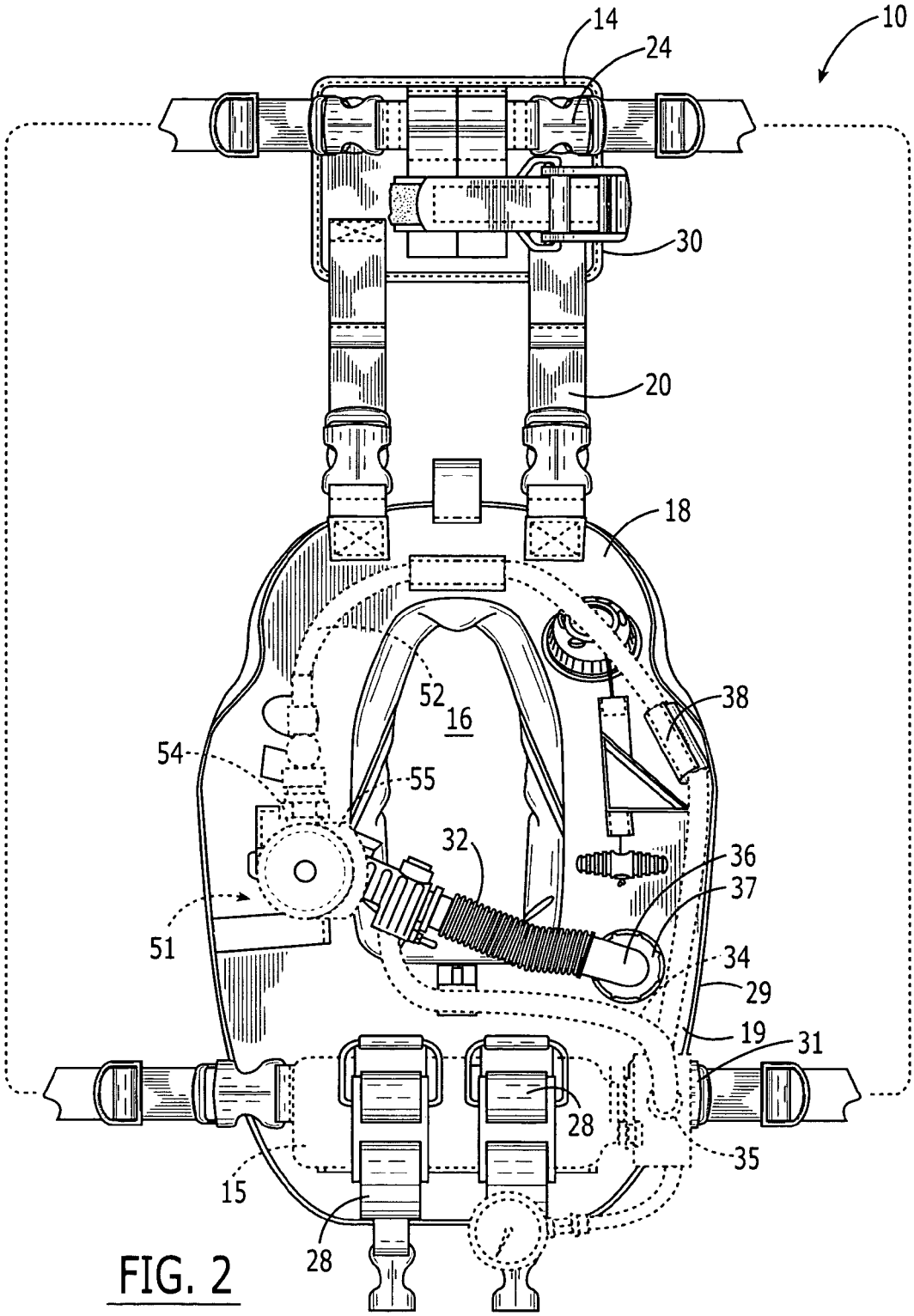
FIG. 2 is a top plan view of the vest of FIG. 1 including a tank and regulator.
Figure 3:
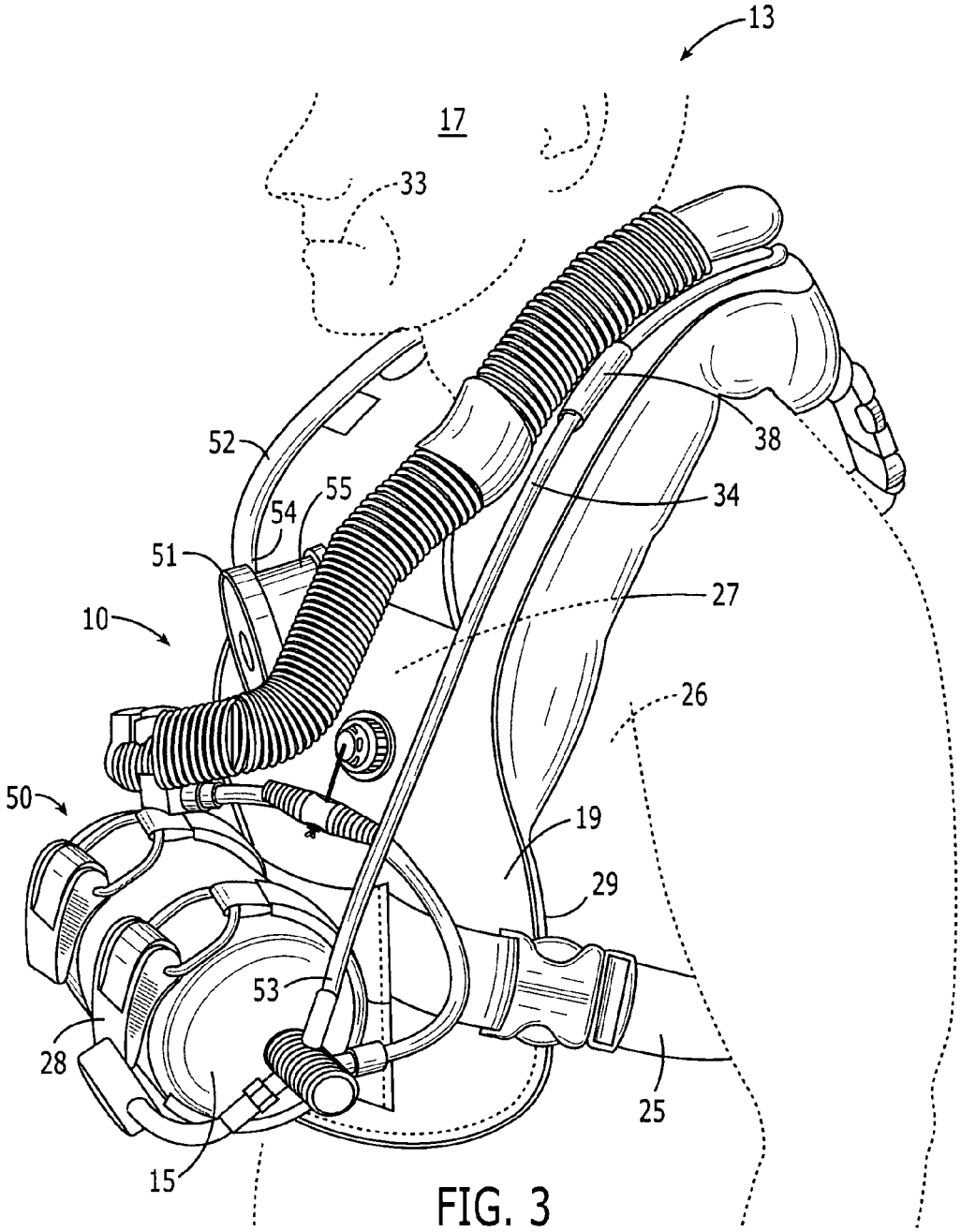
FIG. 3 is a side-front perspective view of an assembled vest of FIG. 1 worn by a user.
Figure 4:
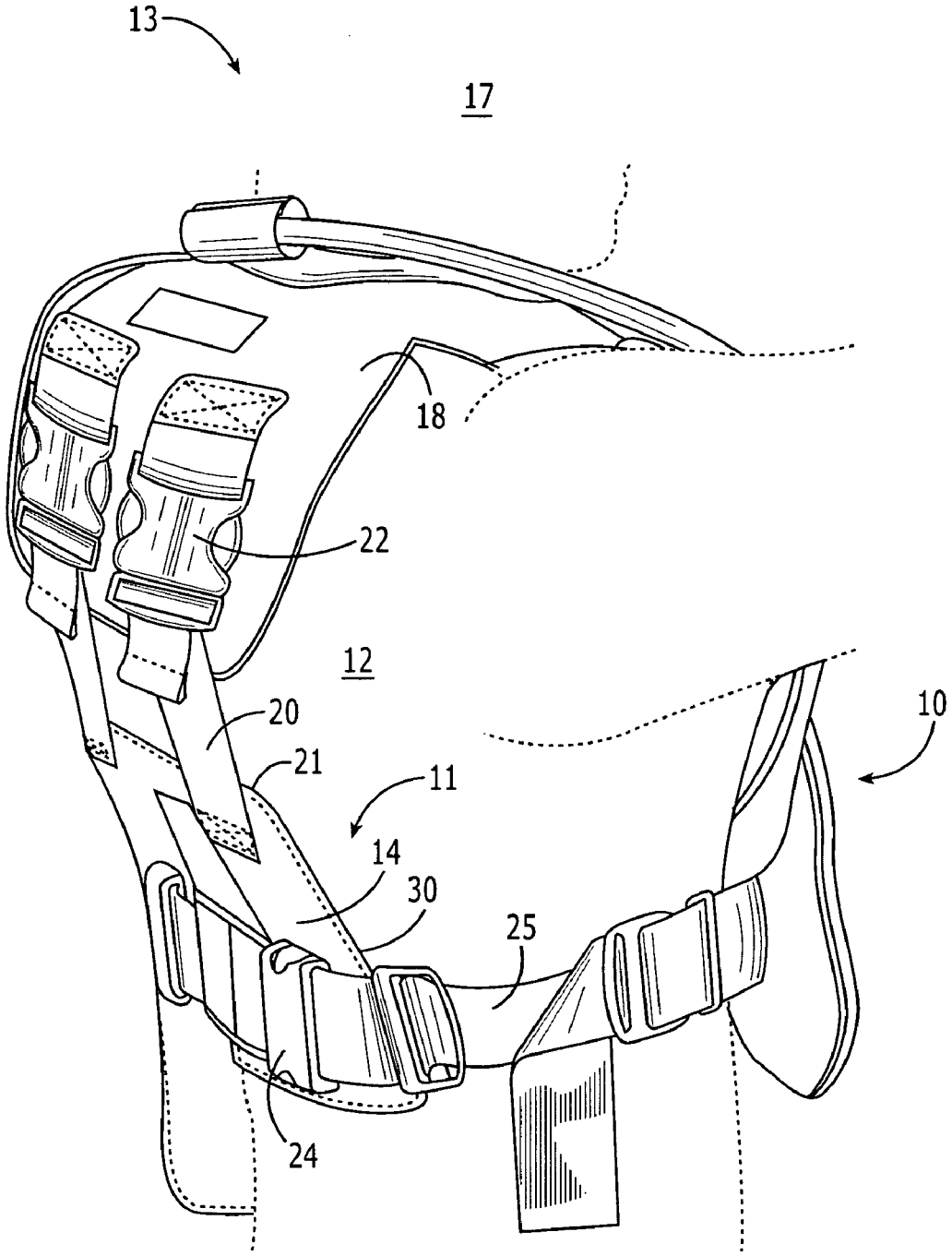
FIG. 4 is a side-rear perspective view of an assembled vest of FIG. 1 worn by a user.
Figure 5:
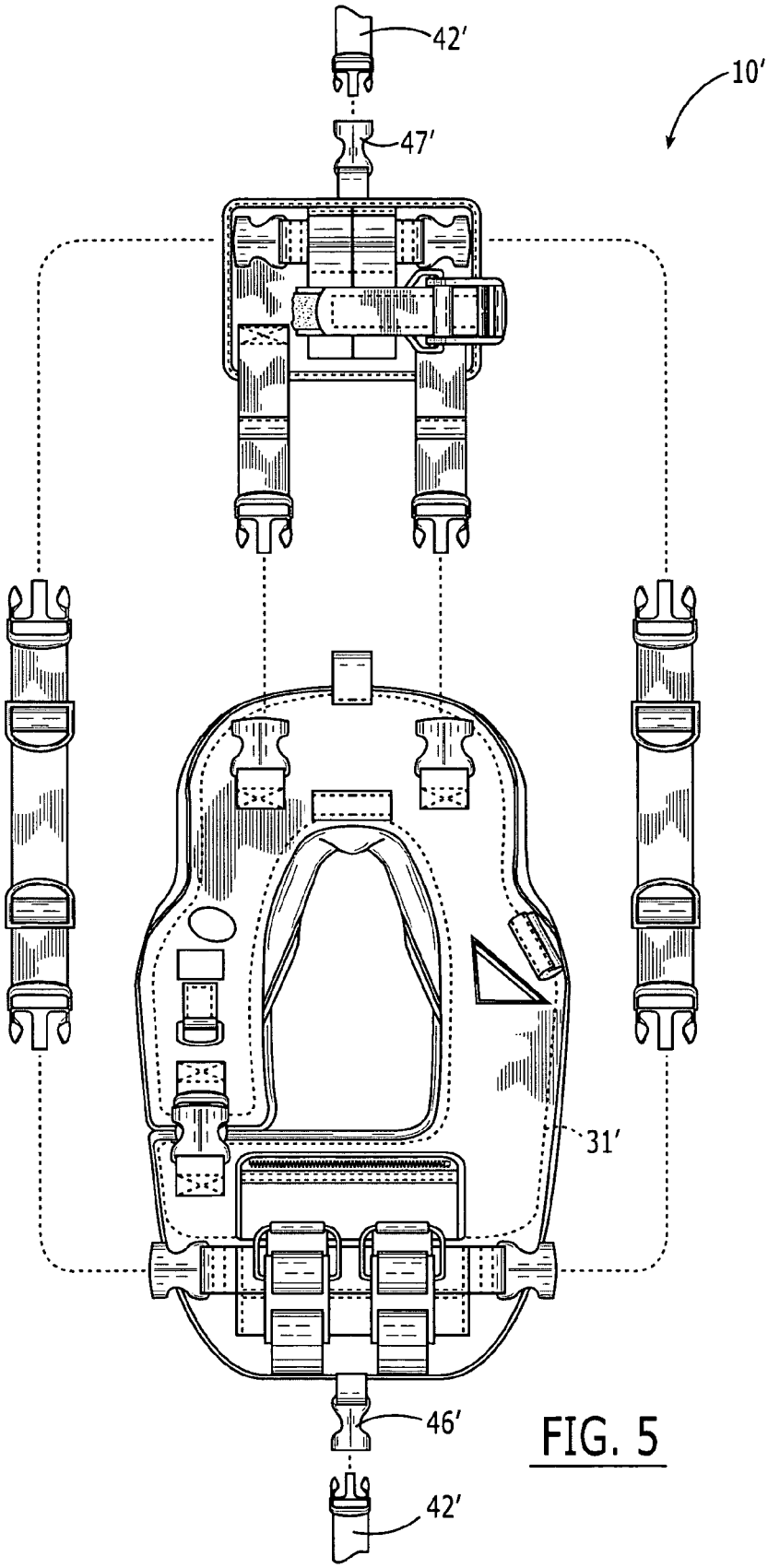
FIG. 5 is an exploded top plan view of a second embodiment of a buoyancy vest of the present invention positioned flat.

A first aspect of the invention is directed to a buoyancy vest 10 and system for aquatic breathing (FIGS. 1–4). The buoyancy vest 10, which may comprise a flexible material such as, but not intended to be limited to, ballistic nylon, comprises a back portion 11 that is positionable adjacent a back 12 of a user 13 (FIG. 4). In a particular embodiment, the back portion 11 comprises a generally planar element 14 that is dimensioned and positioned for assisting in load bearing, in particular, for assisting in supporting a weight of an air tank 15 affixed to the vest 10.

The vest 10 in an exemplary embodiment has a hole 16 therethrough for admitting a head 17 of the user 13 thereinto. Thus is formed a generally toroidal element, with a rear neck portion 18 on an opposite side from a front portion 19. The planar element 14 may be affixed, for example, to the rear neck portion 18 by means of a pair of adjustable and releasable straps 20 that extend between a top 21 of the planar element 14 and strap clips 22 extending from a bottom 23 of the rear neck portion 18. The straps 20, for example, may comprise retaining cam straps.

The planar element 14 also includes strap clips 24 for receiving side straps 25, to be discussed in the following.

The vest 10 further includes a front portion 19 that is positionable adjacent a chest 26 of the user 13 (FIG. 3). The front portion 19 comprises a support element that is adapted for removably affixing an air tank 15 thereto. The support element, which is positioned for resting adjacent a sternum 27 of the user 13, in a particular embodiment, includes a pair of length-adjustable straps 28, affixed in substantially perpendicular relation to the vest's front portion 19 in an orientation that is adapted for supporting the air tank 15 substantially horizontal. The straps 28 may comprise reinforced material.

The preferred tank orientation has proved to be beneficial for a number of reasons. When the tank 15 is positioned on the user's chest 26, instead of on the back 12, the user's balance in the water and on land is much more easily retained. In the water, the tank 15 acts like a keel or pivot point, making it easy to change orientation, and also permits the user to assume a preferred underwater position with an arched back. When in place, the tank 15 can also act as a shelf for the user to place objects upon. With this vest 10, the user can enter the water forward, which is much less intimidating and awkward than back-mounted systems.

A pair of side straps 25 is provided wherein each side strap 25 is affixable in connecting relation between the front 19 and the back 11 portion to respective opposed sides 29,30 thereof, here via strap clips 24 on the back portion 11 and strap clips 31 on the front portion 19, which are generally at the same level as the air tank support straps 28. Preferably the side straps 25 are adjustable in length, both by pulling forward and backward, for ease of use. The straps 25, for example, may also comprise retaining cam straps.

The vest 10 also includes a buoyancy element 31 housed within the front portion 19, such as, but not intended to be limited to, an air bladder or foam. In the embodiment shown in FIGS. 1–4, the buoyancy element comprises a buoyancy compensator 31 that comprises at least one means for admitting a gas thereinto and for releasing gas therefrom, for providing a variable vest buoyancy. In order to provide for oral inflation, the gas admitting means comprises a first tube 32 that extends into the buoyancy compensator 31. In this instance, the first tube 32 is sufficiently long to reach a mouth 33 of the user 13, as shown in FIG. 3.

In order to permit inflation via the air tank 15, the gas admitting means comprises a second tube 34 that is connectable at a first end 35 to the air tank 15 and at a second end 36 to the buoyancy compensator 31, such as to a valve 37 adjacent the user's chest 26. The second tube 34 should be sufficiently long to reach the valve 37 (FIG. 2), and preferably be sufficiently long to wrap around the user's head 17 to terminate at the second end 36 (FIG. 3). In this embodiment the second tube 34 is retained on the user's chest 26 with the use of a tube support element, for example, a fabric loop 38 having Velcro® hook-and-loop-type closures affixed to the vest 10, although this is not intended to be limiting. The valve 37 also serves as a gas releasing means, and is connected to a manual actuator 39 comprising a line 40 and a pull handle 41 in operative connection therewith.

In another embodiment 10' (FIG. 5), the buoyancy element 31' comprises an element having substantially fixed buoyancy, such as foam or an air bladder. This embodiment is usable, for example, for surface swimming, and will generally not permit submersion.

Additional securing capability may also be provided by a bottom adjustable strap 42 that is affixed in releasable connecting relation between lower ends 43,14 of the front 19 and the back 11 portions via strap clips 44,45. In a first embodiment, shown in FIG. 2, the bottom strap 42 comprises a split-saddle strap, which connects with a pair of strap clips 46 in the front and a unitary strap clip 47 in the back. In another embodiment 10', shown in FIG. 5, the bottom strap 42' comprises a unitary strap, which connects with a front strap clip 46' in front and a back strap clip 47' in the back.

Additional elements may be incorporated into the vest 10, such as an accessories hanging element 48 for attaching other desired objects therefrom, an additional strap 49 affixed to the back portion 11 for attaching a conventional underwater tank thereto, and a saddle harness (not shown) for permitting a user to be hauled out of the water.

Another aspect of the invention is directed to a system 50 for aquatic breathing. The system 50 comprises a buoyancy vest 10,10', such as described above. The system 50 further comprises an air tank 15 supported by the support element. Preferably the air tank 15 comprises a "pony tank," which weighs approximately 10 lbs, as opposed to a conventional scuba tank, which weighs 50 lbs. This tank 15 has a capacity of approximately 20 $ft^3$, although this is not intended to be limiting, and one of skill in the art will recognize that other size tanks, such as 13 $ft^3$, can also be accommodated. This flexibility is conferred at least in part by the adjustable nature of the front straps 28.

The system 50 also comprises a regulator 51. The regulator 51, such as those known in the art, comprises a hose 52 that is connected in fluid communication at a first end 53 to the air tank 15 and at a second end 54 to a mouthpiece 55.

It may be appreciated by one of skill in the art that the system 50 and vests 10,10' are highly modular, and comprise interchangeable parts, adding to the flexibility of the invention.

Another aspect of the present invention is directed to a method for achieving controlled breathing of a desired gas. This method may be used for underwater breathing, or for breathing on- or off-shore in contaminated areas. The method comprises the steps of donning a vest 10 such as described above. The buoyancy of the buoyancy compensator 31 is adjusted to a desired level if required, and the user 13 can breathe through the mouthpiece 55.

It may be appreciated by one of skill in the art that embodiments of the present invention may keep a diver in the horizontal position on the water or underwater while supplying contained air. The invention may also provide buoyant compensation on the surface, is capable of being deflated in order to enable the user to submerge.

The vest 10 clearly facilitates a rapid release and mounting of an air tank 15, which makes the invention usable not only for recreational purposes, but also for use by the military, police, fire department, and other rescue workers. The reduced size and weight of the invention over conventional scuba equipment makes the vest 10 and system 50 easy to put on and take off and more amenable to carrying in vehicles, such as automobile trunks and aircraft.

Yet another aspect of the invention includes a business model including a method for providing an aquatic breathing experience to a customer. This aspect of the method comprises the steps of establishing an aquatic breathing system outlet adjacent a body of water and offering to rent an aquatic breathing system to a customer. Such an establishing step may take the form of opening such a business, or franchising such a business.

The customer is permitted to don the aquatic breathing system 50 by placing a front portion 19 of a vest 10 adjacent a sternum 27 of the customer 13 and placing a back portion 11 of the vest 10 adjacent a back 12 of the customer 13. The front 19 and the back 11 portions of the vest are affixed together using releasable, length-adjustable side straps 25 that are affixed in connecting relation therebetween.

Next an air tank 15 is attached to the vest 10 in a substantially horizontal orientation using releasable length-adjustable straps 28 affixed to the vest front portion 19. A regulator 51 is attached to the air tank 15 for permitting a flow of air from the air tank 15 to a mouthpiece 55 of the regulator 51.

The customer 13 is permitted to enter the body of water and to adjust a buoyancy of a buoyancy compensator 31 to a desired level, and then to breathe through the mouthpiece 55. When the experience is finished, the aquatic breathing system 50 is received back from the customer 13. At this point the air tank 15 will typically be refilled.

It may be appreciated by one of skill in the art that the present invention may be used to explore the surface of the water without learning the breathing techniques of snorkeling or conventional scuba diving. The invention may be used with a standard mask or goggles, and further may be used as a training device for those who are not certified in scuba diving, but who would like to eventually learn to scuba dive and how to breathe contained air through a mouthpiece. Embodiments of the invention may be especially useful for children that are too young to be certified in scuba diving or for all people that are inexperienced swimmers, by way of example. The invention is also useful for resort settings where a customer wishes to have the experience of underwater viewing and diving, but does not wish to undertake a lengthy and expensive training and certification process.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the system illustrated and described herein are by way of example, and the scope of the invention is not limited to the exact details of construction and use.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. An aquatic breathing apparatus comprising a buoyancy vest comprising:

a generally toroidal element having a hole therethrouqh for admitting a head of a user thereinto, the toroidal element having a rear neck portion and a front portion positionable adjacent a chest of the user, the front portion comprising a support element adapted for removably affixing an air tank thereto, the support element positioned for supporting the air tank adjacent a sternum of the user;

a back portion positionable adjacent a back of a user, the back portion comprising a generally planar element dimensioned and positioned for assisting in supporting a weight of an air tank affixed to the support element, wherein the planar element is affixable to the rear neck portion;

a buoyancy element at least partially housed within the front portion; and a pair of side straps, each side strap affixable in connecting relation between the front and the back portion to respective opposed sides thereof and positioned at a level generally the same as that of the support element, for encircling the user at a level generally of the sternum.

2. The aquatic breathing apparatus recited in claim 1, further comprising adjustable and releasable straps extending between a top of the planar element and the rear neck portion.

3. The aquatic breathing apparatus recited in claim 1, wherein the side straps are adjustable in length.

4. The aquatic breathing apparatus recited in claim 1, wherein the buoyancy element comprises a buoyancy compensator, the buoyancy compensator comprising means for admitting a gas thereinto and for releasing gas therefrom, for providing a variable vest buoyancy.

5. The aquatic breathing apparatus recited in claim 4, wherein the gas admitting means comprises a tube extending into the buoyancy compensator, the tube sufficiently long to reach a mouth of a user wearing the vest, for permitting oral inflation.

6. The aquatic breathing apparatus recited in claim 4, wherein the gas admitting means comprises a tube connectable at a first end to the air tank affixed to the support element and at a second end to the buoyancy compensator.

7. The aquatic breathing apparatus recited in claim 4, wherein the gas releasing means comprises an air release valve in fluid communication with the buoyancy compensator and a manual actuator in operative connection therewith.

8. The aquatic breathing apparatus recited in claim 1, wherein the buoyancy element comprises an element having substantially constant buoyancy.

9. The aquatic breathing apparatus recited in claim 1, wherein the support element comprises a pair of length-adjustable straps, affixed in substantially perpendicular relation to the vest front portion in an orientation adapted for supporting an air tank substantially horizontal.

10. The aquatic breathing apparatus recited in claim 1, further comprising a bottom adjustable strap affixed in releasable connecting relation between lower ends of the front and the back portions.

11. A system for aquatic breathing comprising:

a buoyancy vest and air tank support for aquatic breathing comprising:

a generally toroidal element having a hole therethrough for admitting a head of a user thereinto, the toroidal element having a rear neck portion and a front portion positionable adjacent a chest of the user, the front portion comprising a first support element adapted for removably affixing an air tank thereto, the support element positioned for supporting the air tank adjacent a sternum of the user, and a second Support element positioned above the first support element and adapted to releasably affix a hose to the vest front portion;

a back portion positionable adjacent a back of a user, the back portion comprising a generally planar element dimensioned and positioned for assisting in supporting a weight of an air tank affixed to the first support element, wherein the planar element is affixable to the rear neck portion;

a buoyancy compensator housed within the front portion; and a pair of side straps, each side strap affixable in connecting relation between the front and the back portion to respective opposed sides thereof and positioned at a level generally the same as that of the first support element, for encircling the user at a level generally of the sternum;

an air tank supported by the first support element; and a regulator comprising a hose connected in fluid communication at a first end to the air tank and at a second end to a mouthpiece, the hose supported by the second support element.

12. The aquatic breathing system recited in claim 11, further comprising adjustable and releasable straps extending between a top of the planar element and the rear neck portion.

13. The aquatic breathing system recited in claim 11, wherein the buoyancy compensator comprises means for admitting a gas thereinto and for releasing gas therefrom, for providing a variable vest buoyancy.

14. The aquatic breathing system recited in claim 11, wherein the first support element comprises a pair of length-adjustable straps, affixed in substantially perpendicular relation to the vest front portion in an orientation adapted for supporting an air tank substantially horizontal.

15. A method for achieving controlled breathing of a desired gas comprising the steps of:

placing a front portion of a vest adjacent a sternum of a user;

placing a back portion of the vest adjacent a back of the user, the back portion having a substantially planar portion dimensioned for distributing weight carried by the front portion across the back;

affixing together the front and the back portion of the vest using releasable, length-adjustable side straps affixed in connecting relation therebetween, the straps positioned at a level of the sternum;

attaching an air tank to the vest in a substantially horizontal orientation generally adjacent the sternum using releasable length-adjustable straps affixed to the vest front portion;

attaching a regulator to the air tank for permitting a flow of air from the air tank to a mouthpiece of the regulator;

adjusting a buoyancy of a buoyancy compensator to a desired level; and breathing through the mouthpiece.

16. The method recited in claim 15, wherein the buoyancy adjusting step comprises blowing air into a tube in fluid communication with the buoyancy compensator.

17. The method recited in claim 15, wherein the buoyancy adjusting step comprises forcing air through a tube connected at a first end to the air tank and at a second end to the buoyancy compensator.

18. The method recited in claim 15, wherein the buoyancy adjusting step comprises releasing gas from an air release valve in fluid communication with the buoyancy compensator by activating a manual actuator connected thereto.

19. A method of providing an aquatic breathing experience to a customer comprising the steps of:

establishing an aquatic breathing system outlet adjacent a body of water;

offering to rent an aquatic breathing system to a customer;

permitting the customer to don the aquatic breathing system by:

placing a front portion of a vest adjacent a sternum of the customer;

placing a back portion of the vest adjacent a back of the customer user, the back portion having a substantially planar portion dimensioned for distributing weight carried by the front portion across the back;

affixing together the front and the back portion of the vest using releasable, length-adjustable side straps affixed in connecting relation therebetween, the straps positioned at a level of the sternum;

attaching an air tank to the vest in a substantially horizontal orientation generally adjacent the sternum using releasable length-adjustable straps affixed to the vest front portion; and attaching a regulator to the air tank for permitting a flow of air from the air tank to a mouthpiece of the regulator;

permitting the customer to enter the body of water;

permitting the customer to adjust a buoyancy of a buoyancy compensator to a desired level;

permitting the customer to breathe through the mouthpiece; and receiving the aquatic breathing system back from the customer.

* * * * *